United States Patent [19]

Boahn

[11] 4,219,005

[45] Aug. 26, 1980

[54] FIREPLACE HEATING UNIT

[76] Inventor: Alfred Boahn, Rte. 5, Box 361-G, Fayetteville, N.C. 28301

[21] Appl. No.: 883,535

[22] Filed: Mar. 6, 1978

[51] Int. Cl.[2] ..... F24B 7/00

[52] U.S. Cl. ..... 126/121; 126/139; 237/51; D23/94

[58] Field of Search ..... 126/121, 120, 123, 135, 126/136, 138, 139, 128, 126, 140, 192, 193, 197, 202; 237/51; 292/7; D23/94

[56] References Cited

U.S. PATENT DOCUMENTS

| | | | |
|---|---|---|---|
| 1,670,212 | 5/1928 | Richter | 126/121 |
| 1,681,995 | 8/1928 | Miles | 126/138 X |
| 2,158,041 | 5/1939 | Covert | 126/121 |
| 2,270,940 | 1/1942 | Elmore | 126/121 |
| 3,187,526 | 6/1965 | Moler | 292/7 X |
| 3,788,678 | 1/1974 | Switzgable | 292/7 |
| 3,894,527 | 7/1975 | Ickes | 126/140 |
| 3,901,212 | 8/1975 | Stites | 126/121 |
| 4,004,731 | 1/1977 | Zung | 126/110 R X |
| 4,091,794 | 5/1978 | Stites | 126/121 |
| 4,095,581 | 6/1978 | Billmeyer et al. | 126/121 |
| 4,108,144 | 8/1978 | Wilhoite | 126/120 |
| 4,112,915 | 9/1978 | Slavik | 126/121 |
| 4,119,081 | 10/1978 | Edwards | 126/140 |
| 4,137,895 | 2/1979 | Bittinger | 126/120 |

FOREIGN PATENT DOCUMENTS

| | | | |
|---|---|---|---|
| 2316548 | 1/1977 | France | 126/121 |
| 612708 | 11/1948 | United Kingdom | 126/120 |

*Primary Examiner*—Samuel Scott
*Assistant Examiner*—Randall L. Green
*Attorney, Agent, or Firm*—Mills & Coats

[57] ABSTRACT

In abstract a preferred embodiment of this invention is an improved fireplace heat exchanger in the form of an integral heat exchange system, fireplace closure, air tight glass doors and an outside air introduction system. The unit is built as a single unit and is installed as such either in new construction or preexisting fireplaces. The invention also includes a unique door locking system to assure air tight integrity between the interior of the house and the fire in the fireplace.

9 Claims, 7 Drawing Figures

FIREPLACE HEATING UNIT

BACKGROUND OF INVENTION

This invention relates to heat exchangers and more particularly to improved fireplace type heating units.

In the past tube type heat exchangers have been used in fireplaces. These units today generally take the form of a front manifold with heating pipes which act as a grate for the fire logs thereon, curving up and going back out into the room in generally a U-shaped configuration. A blower is quite often attached to the front of the manifold to force the air through the heat exchanger rather than depending on convection currents.

Also the use of glass doors has become relatively common. These generally take the form of two pairs of folding doors for a total of four glass panels with a relatively flimsy frame thereabout and a damper at the bottom to allow air from inside the house to feed the fire for combustion purposes when the doors are closed.

With the cost of fossil fuel going up and home owners becoming more aware of energy conservation, heat exchangers of the type described are being used in conjunction with separate glass doors which are in most cases purchased from different suppliers.

The broad concept in and of itself of introducing air from the exterior of a building into the firebox portion of a fireplace to effectuate combustion and either reduce or eliminate warm interior air from being sucked up the chimney during the burning process of the fire is known. The detailed construction of these air inlet systems, however, are usually of relatively exotic design and are at best costly to install. Also the air control of such air feed systems leaves much to be desired.

SUMMARY OF INVENTION

After much research and study into the above types of devices and the inherent drawbacks of each, the present invention has been developed to provide in a single integral unit means for circulating ambient interior air through a heat exchanger located adjacent the firebox area of the fireplace and back out into the room thus heating the same. This portion of the present invention is integrally combined with a fireplace closure in the form of two relatively large glass doors mounted in a heavy steel frame with dog type locking means to provide an air tight closure for the fireplace opening to prevent ambient interior air from being sucked up the chimney when a fire is burning in the fireplace.

Combined with the nonflame contacting heat exchanger and the air tight fireplace closure is a means for introduction of ambient exterior air into the interior of the fireplace to support combustion of the fire therein. This exterior air feed means is integral with the other portions of the present invention and includes simple and yet efficient damper means for regulating the flow of air to the fire thus allowing regulation of the burning rate of such fire and thereby the heat radiatingly given off therefrom.

In view of the above, it is an object of the present invention to provide, in a single integral unit, a nonflame contacting heat exchanger, an air tight closure for a fireplace opening and damper regulated means for introducing ambient exterior air into the fireplace.

Another object of the present invention is to provide, in a fireplace closure means, a means for positively locking air tight doors in a closed position during circulation of ambient interior air through the heat exchange means.

Another object of the present invention is to provide in a fireplace glass door type closure a rolling block type dog system for snugging down and holding the doors in relatively air tight relationship to the adjacent frame.

Another object of the present invention is to provide an ambient interior air circulation heat exchange system for fireplaces wherein there is no normal direct contact between the exchanger thereof and the flame of the heating fire.

Another object of the present invention is to provide, in a forced air type fireplace heat exchanger, a bent L-shaped manifold constructed of at least one quarter inch steel with a plurality of heavy gauge heat exchange tubes connected thereto and disposed in such a manner that usual contact with direct flame is prevented thus giving long term, trouble free usage.

Another object of the present invention is to provide, in a tube type fireplace heat exchange means, a plurality blower to circulate the air therethrough.

Another object of the present invention is to provide, in a fireplace type heat exchanger, a multiple, independent exchange means.

Another object of the present invention is to provide an improved damper control to regulate ambient exterior air being introduced into an enclosed fireplace system.

Other objects and advantages of the present invention will become apparent and obvious from a study of the following description and the accompanying drawings which are merely illustrative of such invention.

DETAILED DESCRIPTION OF PREFERRED EMBODIMENT

Figure 7:
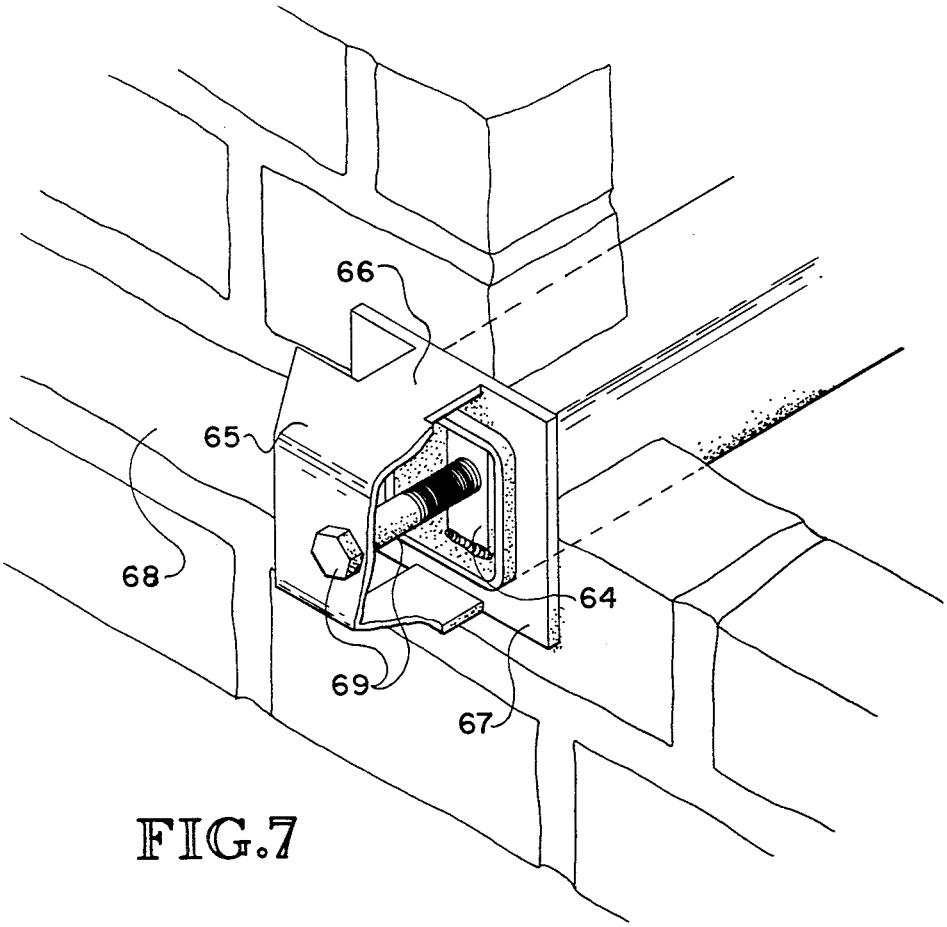
FIG. 7 is a fragmentary exploded perspective view of the heat exchange unit securing an outside ambient air inlet portion of the present invention.
Figure 1:
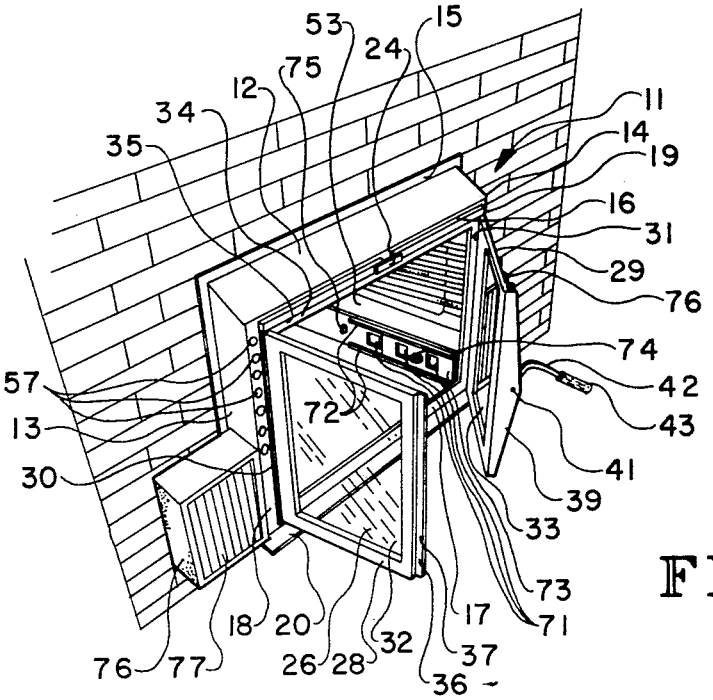
FIG. 1 is a front perspective view of the improved fireplace heat exchanger of the present invention.

With further reference to the drawings, the improved fireplace heat exchanger means of the present invention, indicated generally at 10, includes a generally U-shaped shroud 11 whose top 12 slants downwardly and whose sides 13 and 14 slant slightly inwardly as seen clearly in FIG. 1. About one edge of shroud 11 is provided a fireplace face engaging flange 15 which is an integral part of said shroud. On the opposite edge of shroud 11 from flange 15 is a generally flat front portion including an upper section 16, a lower section 17, and side sections 18 and 19 forming an integral part of the shroud. A generally flat hearth engaging threshold plate 19 is welded or otherwise secured to the bottom portion of shroud 11 again as seen in the FIGS., particularly FIG. 1.

To the upper and lower sections 16 and 17 of the front portion is secured by bolting, riveting or otherwise a pair of adjacent elongated rectangular door jam means 21. Small gaps 22 and 23 are provided between the paired frame members as seen in the FIGS. Over these gaps are provided locking bars 24 and 25, respectively. These, like members 21, are fixedly secured to the front portion by bolts, rivets or the like.

Each of the doors 26 and 27 are constructed of a relatively heavy duty frame 28 and 29, respectively. Along one edge of these two frames is secured a piano type hinge means 30 and 31, respectively, which are also secured to side sections 18 and 19 of the front portion.

The transparent windows 32 and 33 of frames 28 and 29 are preferably formed from at least one-quarter inch thick tempered glass. This glass is set in an asbestos lining (not shown) to make the mounting between each of the windows and its respective frame air tight. Around the flat area adjacent the interior periphery of the front portion along all sections is provided with an asbestos gasket 34. Along the edge of door 26 where it joins door 27 is provided an interior flange 35. This flange also has an asbestos gasket provided on the edge of the surface that lies juxtaposed to door 27 when the doors 26 and 27 are in the closed position. Thus it can be seen that when said doors are in said closed position, the air tight asbestos gaskets completely line all juxtaposed surfaces.

Figure 4:
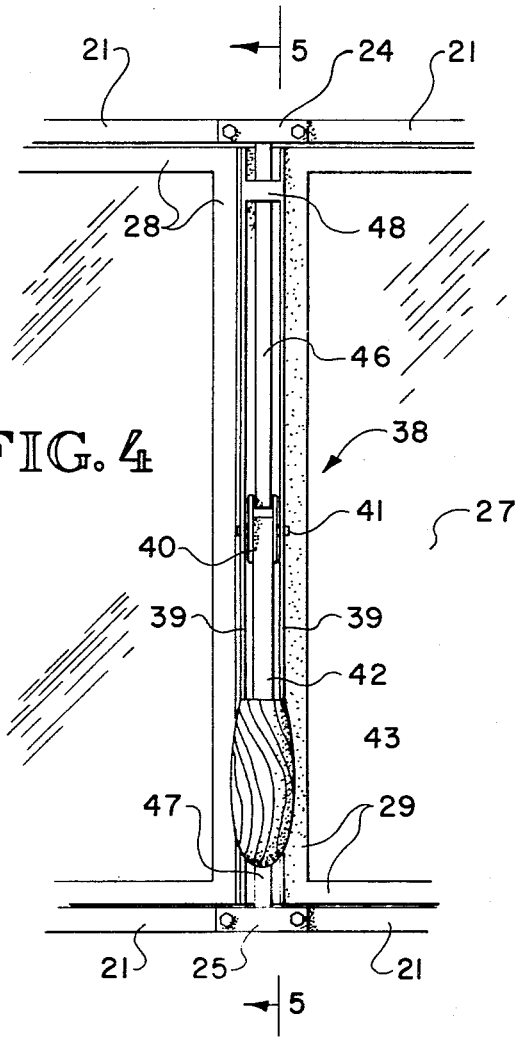
FIG. 4 is an enlarged view of the door locking means of the present invention.

To positively lock and hold doors 26 and 27 in air tight closed position, a locking mechanism indicated generally at 38 is provided. This mechanism includes a pair of generally parallelly disposed flanges 39 fixedly secured to the frame 29 of door 27. Between flanges 39 and the central portion thereof is rotatively mounted a pair of pivot discs 40 on shaft 41 as seen clearly in FIGS. 4 and 5. A generally L-shaped arm 42 is fixedly secured by weldment or otherwise to discs 40 on either side thereof. At the end of arm 42 opposite disc 40 is provided a handle 43 preferably constructed from a low temperature conductive material such as wood.

Pivotably attached between disc 40 by means such as pins 44 and 45 are elongated generally flat rod like locking dogs or arms 46 and 47, respectively. Each of these locking arms is beveled on its end opposite the pin connection with discs 40 as can clearly be seen in FIG. 5. This beveling aids in guiding the locking rods or arms into the respective upper and lower gap openings 22 and 23 as will hereinafter be set forth in more detail.

Locking arm guide means 48 are provided simply to prevent the locking arms from loosely flapping about when the door 27 is in the open position.

Figure 5:
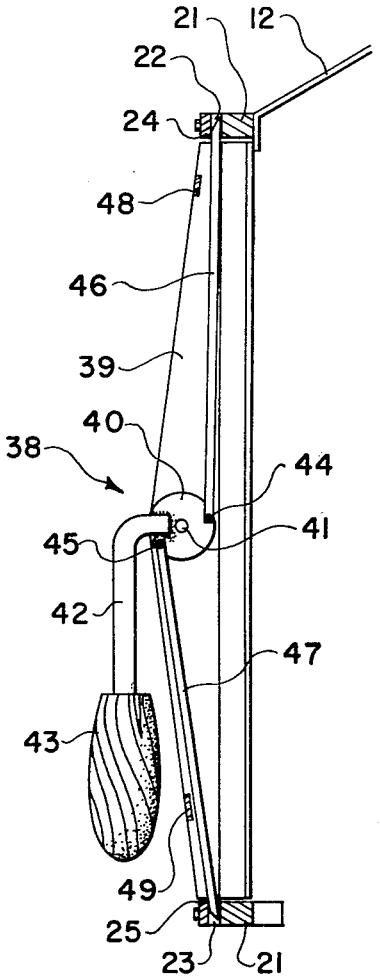
FIG. 5 is a sectional view taken through lines 5—5 of FIG. 4.
Figure 6:
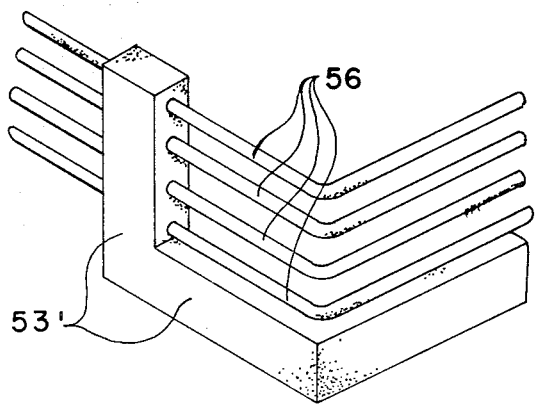
FIG. 6 is a fragmentary view of the single blower heat exchange version of the present invention.

As can clearly be seen in FIG. 5, the more downwardly pressure that is placed on handle 43, the tighter the locking seal is provided to door 27 and thus to door 26. This assures air tight integrity between the inside 50 of the structure and the fireplace 51.

Figure 3:
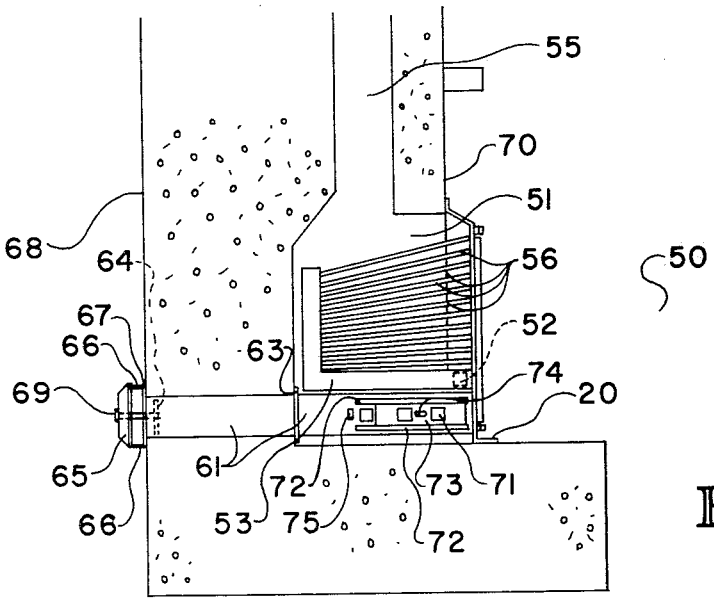
FIG. 3 is a sectional view taken through lines 3—3 of FIG. 2 showing the heat exchanger of the present invention in installed operative position.

An opening 52, indicated by dotted lines in FIG. 3, is included in the lower portion of each of the sides 13 and 14 of the shroud. These two openings communicate from the exterior shroud into manifolds 53 and 54, respectively. Each of these manifolds are welded or otherwise air tightly secured to the interior of the respective shroud side so that air passing through opening 52 will enter the manifold. Each of these manifolds extends toward the back of the fireplace at a slight angle (since most fireplaces are tapered toward the back) and turns at slightly less than 90 degrees to an area adjacent the center rear portion of fireplace. Then extends upwardly to terminate in the area adjacent where the fireplace curves forward to join the flue 65 thereof. A plurality of heat exchange tubes are communicatively attached to the edge of the upright portion of each of the manifolds and follow the general contour of such manifold to the respective side sections of the front portions 18 and 19 where such manifold tubes terminate in heat exhaust openings 57.

Blowers 58 and 59, preferably of standard squirrel cage type which are commerically available and having a rating of approximately 130 CFM, are operatively connected to openings 52 of manifolds 53 and 54, respectively. Thus it can be seen that when electricity is connected to line chords 60 of each of the blowers, ambient interior air will be sucked in thereby and blown through opening 52, through each of the manifolds 53 and 54, will be heated by radiant heat of the fire in the fireplace 51 as it moves from the manifold through the heat exchange tubes 56, and is exhausted as heated air through tube openings 57 in the side sections of the front portion of the shroud.

Welded or otherwise secured to the lower portion of the backwardly extending section of each of the manifolds 53 and 54 is an ambient exterior air inlet manifold 61 and 62, respectively. A collar 63 is provided on each of these manifolds which is adapted to lie juxtaposed to the fire brick of the fireplace 51 as can clearly be seen in FIG. 3. The outermost end of each of the inlet manifolds 61 and 62 includes a threaded pull down bar 65 fixedly secured interiorly of the manifold. An exterior manifold cap 65 is provided which includes a spacer 66 and a flange plate 67 which in assembled position lies juxtaposed to the exterior of the chimney 68 and secures the entire heat exhanger unit 10 in permanent position relatively to fireplace 51. A pull down bolt is passed through each cap 65 and threadedly engages pull down bar 64 so that collar 67 can be pulled tightly against the back of chimney 68 and held in such position thus assuring flange 15 can maintain an air tight juxtaposed relationship to fireplace face 70.

The interior side of each of the air inlet manifolds 61 and 62 adjacent respective doors 26 and 27 is provided a plurality of damper openings 71. An L-shaped in cross section 72 is provided both above and below damper openings 71 as can clearly be seen in FIG. 1. These guide flanges 72 slidingly support and retain damper closure 73 which includes a plurality of openings corresponding to damper openings 71. A handle means 74 is provided for each of the damper closures so that a poker or other handle means can be used to slidingly operate the damper closures to regulate the air flow through openings 71.

Stops in the form of flanges 75 are provided at each end of each of the damper closures 73 thus limiting the travel of such closures from open to closed position.

Primarily for aesthetic purposes, a blower housing 76 is provided about each of the blowers 58 and 59. The front portion of these housings are preferably louvered as shown at 77 to allow ambient interior air to freely pass through said blowers while the same are operating. Also housing 76 is disposed adjacent to but not juxtaposed to the fireplace face 70 so that air can be drawn into the blowers from the back side of the housing as well as through the louvered face 77.

Figure 2:
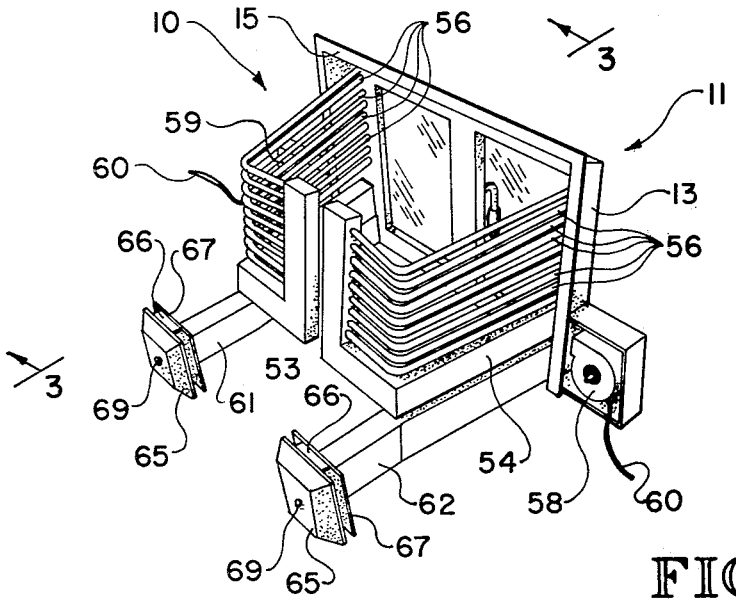
FIG. 2 is a rear perspective view thereof.

From the above, it can be seen that the fireplace heat exchanger unit 10 of the present invention is a single integral unit with all the parts fixedly secured to each other as seen clearly in FIG. 2.

To install this exchanger unit, openings are formed in the rear of the fireplace 51 and air inlet manifolds 61 and 62 are passed therethrough. End caps 65 are placed over the exterior end of each of the inlet manifolds and bolts 69 are threaded into pull down bars 64 inside each of said manifolds thus pulling shroud flange 15 tightly against the fireplace face 70. Once thusly installed, asbestos corking is placed in any cracks or crevices that may be found between the fireplace face 70 and the interior side of flange 15, particularly if such face is composed of brick, stone or other irregular surfaces. Likewise, asbestos corking is used between threshold plate 20 and hearth 78 to assure an air tight seal between the interior of the house 50 and the inside of fireplace 51. One thing that can be clearly noted from the drawings is that there is no obstruction from the bottom to the top of the fireplace, the exchange unit 10 of the present invention being disposed around the side walls and rear of the fireplace.

Once the heat exchange unit of the present invention has been installed as hereinabove described, a standard grate, and/or andirons of the like can be located in the fireplace at the usual location and in the usual manner. Experience has shown that using a standard wood grate in combination with andirons allows a relatively large amount of wood to be placed on the fire at night for slow burning for many hours. The grate, of course, holds the burning logs and the andirons prevent the same from accidentally rolling out against the doors 26 and 27.

Once the fire has been built in the fireplace 51, the damper controls are preferably open on both sides to allow a maximum amount of ambient outside air to enter the fireplace area. If desired to get additional air to the fire during the initial start-up stage, the doors 26 and 27 can be left slightly ajar until the greater amount of smoking stops and the fire is burning well. The doors can then be closed and dogged down with handle 43 as hereinabove described.

Experience has shown that within approximately fifteen minutes, enough heat will be radiated to the heat exchange tubes 56 to emit warm air from exhaust openings 57 when the blowers 58 and 59 are turned on. Thereafter the air emitted therefrom will gradually increase until very hot air can be felt blowing in the middle of a relatively large size room.

Once the desired temperature is reached in the area where the heat exchanger of the present invention is installed, doors 26 and 27 can be opened and the air inlet damper closures 73 slidingly moved to regulate the amount of air coming through openings 71. Thus the intensity of the fire can be regulated to very accurately control the interior ambient room temperature.

Before retiring at night, several logs can be placed on the fire in the fireplace and the blowers left running to maintain the heat in the ambient interior area during the night. The dampers are, of course, almost completely closed so that the fire will burn at a relativley slow rate during the following 7 to 9 hours.

Using the heat exchanger of the present invention, it has been found that almost complete combustion of the logs or other combustible means being burned is achieved. A fire can be burned continuously for at least 3 to 4 days and up to 5 or more days depending on the intensity of the fire burned and whether it is continuous or intermittent before accumulations of ashes are required to be removed. This is, of course, considerably better than the standard open fireplace wherein 24 hours of burning or 2 days of intermittent burning will usually require the ashes to be removed before further burning can be accomplished.

The entire unit of the present invention including shrouds, flanges, thresholds, heat and air manifolds and the like are preferably constructed of quarter-inch steel with heavy duty heat exchange tubes, door frames and blower housings.

In addition to the above, the heavy duty high capacity blowers operate quietly and yet at 130 CFM apiece which will recycle ambient interior air once every 5.8 minutes or over 10 times per hour in a 18 by 12 foot room. With halls and other rooms leading of of the room containing the fireplace where the heat exchanger of the present invention is installed, the heat capacity of the present invention is capable of heating a moderately large house and yet requires only pennies per hour in electrical consumption and uses renewable fuel rather than one of our fastly vanishing fossil fuels.

Experience has acutally shown that a 18 by 12 foot room with at least three rooms leading off therefrom can be heated up to 85 degrees in a moderately insulated house when the outside temperature is 30 degrees Fahrenheit. Because of natural air circulation and the fact that no air is being drawn from the inside of the house up the chimney, 2000 to 2500 or more square feet of interior space can be comfortably heated using only the heat exchange unit of the present invention.

From the above, it can be seen that the heat exchanger of the present invention has the advantage of providing, in a single unit, a means for completely isolating the interior ambient room air from the fireplace with means for introducing ambients exterior air into the fireplace to support combustion. The unit further incorportated a highly efficient heat exchange means for recirculating and heating interior ambient air without depending on flame contact with the heat exchanger for effectuating heat transfer. The present invention also is aesthetically appealing, is heavily constructed, and is designed to "last a lifetime".

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced herein.

What is claimed is:

1. A fireplace type heat exchange unit comprising: in a single integral unit, a shroud constructed of heavy duty steel disposed adjacent a pre-existing fireplace opening in general air tight relationship therewith; a rearwardly extending heat exchange manifold secured to said shroud; an opening through said shroud communicating from the exterior thereof to the interior of said manifold; a plurality of heat exchange means communicatively secured at one end to the rear portion of the said manifold and extending to and communicating through said shroud at their opposite ends; an exterior ambient air inlet manifold disposed adjacent said heat exchange manifold and extending outwardly through said fireplace with one end of said inlet manifold opening to ambient exterior air and the other end being connected to said shroud, and opening from said air inlet manifold into the fireplace rearwardly of said shroud; securing means connectingly associated with the ambient air end of said air inlet manifold for retainingly securing said integral heat exchange unit within said fireplace; a generally air tight closure means hingedly secured to said shroud and including dog type locking means operatively associated therewith whereby ambient interior air is prevented from entering said fireplace, supporting air for fire combustion being supplied by exterior ambient air from the exterior ambient air inlet manifold; and b'ower means operatively connected to said opening in said shroud communicating to the interior of said heat exchange manifold whereby ambient interior air can be forced through the heat exchange manifold, the heat exchange means, and back out to heat said interior when a fire is burning in said fireplace.

2. The heat exchange unit of claim 1 wherein damper means are provided to regulate air flow through the opening in the ambient exterior air manifold adjacent the interior of the fireplace.

3. The heat exchange unit of claim 1 wherein an asbestos gasket is provided about the periphery of said closure.

4. The heat exchange unit of claim 1 wherein said closure is in the form of a pair of glass doors.

5. The heat exchange unit of claim 1 wherein said steel is at least one quarter inch in thickness.

6. The heat exchange unit of claim 1 wherein said dog type locking means are manipulated through a rolling block type mechanism.

7. The heat exchange unit of claim 6 wherein an elongated handle is used to manipulate said rolling block.

8. The heat exchange unit of claim 7 wherein the end portion of said handle farthest from said rolling block is constructed of heat insulating material.

9. The heat exchange unit of claim 8 wherein said heat insulating material is wood.

* * * * *